US007320317B2

(12) United States Patent
Suzuki

(10) Patent No.: US 7,320,317 B2
(45) Date of Patent: Jan. 22, 2008

(54) AUXILIARY DEVICE FOR ENGINE SPARK PLUG IGNITION

(75) Inventor: Jun Suzuki, Tokyo (JP)

(73) Assignee: Sun Automobile Co., Ltd., Tokyo (JP)

( * ) Notice: Subject to any disclaimer, the term of this patent is extended or adjusted under 35 U.S.C. 154(b) by 0 days.

(21) Appl. No.: 11/415,900

(22) Filed: May 2, 2006

(65) Prior Publication Data

US 2006/0288989 A1 Dec. 28, 2006

(30) Foreign Application Priority Data

Jun. 28, 2005 (JP) ..... 2005-188573

(51) Int. Cl.
*F02P 15/00* (2006.01)

(52) U.S. Cl. ..... 123/654; 123/656; 324/378

(58) Field of Classification Search ..... 123/654, 123/656; 324/378, 395
See application file for complete search history.

(56) References Cited

U.S. PATENT DOCUMENTS 4,317,068 A * 2/1982 Ward et al. ..... 123/654
4,922,883 A * 5/1990 Iwasaki ..... 123/656
6,305,365 B1 * 10/2001 Maeoka et al. ..... 123/620

* cited by examiner

*Primary Examiner*—T. M Argenbright
(74) *Attorney, Agent, or Firm*—Townsend & Banta

(57) ABSTRACT

An auxiliary device for sparkplug ignition is provided having a case, and provided therein, electrolytic capacitors connected in parallel between ground terminals and positive terminals of the primary coils of the ignition coils, which are connected to sparkplugs in a direct ignition system. Diodes, which are connected in parallel, are provided in the reverse direction, between the ground terminals and the positive terminals on the primary coils. The case is fitted with a connector that connects to a dedicated harness. The back electromotive force generated in the primary side coils L1 to L4 of the ignition coils of each sparkplug is absorbed, so as to adjust the primary side current, allowing for generation of stabilized high voltage on the secondary coil side, and producing highly efficient sparkplug ignition.

6 Claims, 9 Drawing Sheets

AUXILIARY DEVICE FOR ENGINE SPARK PLUG IGNITION

FIELD OF THE INVENTION

The present invention relates to technology for supplying current at the time of sparkplug ignition, in an engine ignition system. In particular, an auxiliary device is provided for controlling engine spark plug ignition.

BACKGROUND OF THE INVENTION

Following the move to electronic control, in which gasoline engines are controlled by ECUs (electronic control units), automobile engine ignition systems are now full-transistor systems, in which mechanical points (contact breakers) are not needed, and more recently, there has been a move to ignition systems that do not need distributors, in which the power distribution function is based on mechanical operations, or high-voltage leads (secondary leads) with which energy loss is unavoidable.

Direct ignition systems, which do not need distributors, are provided with a small independent ignition coil for each sparkplug, and ignition is performed by supplying low-voltage (equal to the battery voltage of 12 V) primary side current from an igniter unit. An ordinary connecting lead is sufficient to supply the primary side current to the small, independent ignition coils, and advances in ignition control units have made it possible to control the primary side current for all of the cylinders with a single igniter unit. As such, mechanical power distribution using a distributor is unnecessary.

Note that, in terms of publications relating to automobile engine ignition systems, the specification of Japanese Laid Open Patent Application JP-2004-239115-A discloses a battery voltage stabilization device for stabilizing battery voltage without lowering the same, even when the opening angle of the throttle is suddenly changed to full throttle. In other words, a voltage stabilization circuit for stabilizing battery voltage (12 V) having an electrolytic capacitor element is electrically connected between the positive terminal and the negative terminal of a battery for driving an engine by supplying current to sparkplugs, and a voltage equivalent to the voltage drop produced when there is a sudden variation in the load on the engine is compensated by current released from the electrolytic capacitor element of the voltage stabilization circuit so as to stabilize the battery voltage.

Furthermore, Japanese Utility Model JP-3106434-U proposes an automobile ignition stabilization device, which is a device connected directly in parallel to the automobile battery, as an ignition stabilization device capable of stabilizing the ignition period and producing a strong discharge, wherein an aluminum electrolytic capacitor having a capacitance of no less than 8000 μF, preferably 10,000 to 100,000 μF, and more preferably 15,000 to 60,000 μF, and an inspection device comprising an LED and a series resistors, are connected in series.

In engine ignition systems, whether these be older full-transistor ignition systems provided with a distributor, or direct ignition systems, as can be understood by the graph of measurement data for a primary coil side current waveform at the time of sparkplug ignition shown in FIG. 9, depending on the characteristics of the ignition coil, in the interval A immediately following sparkplug ignition (which is to say, immediately after breaking the primary side current), a negative back electromotive force (arrow C) is generated on the primary coil side. While the ignition energy is so large that the waveform in the arrow B interval is nearly vertical, this also disturbs the waveform.

Research by the present inventor has shown that the back electromotive force that occurs on the primary coil side influences the high-voltage generation on the secondary coil side and decreases the sparkplug voltage, which negatively impacts ignition efficiency. In particular, when the engine is operating at high speed, the secondary coil side sparkplug voltage is unstable and a time lag occurs, which is highly likely to cause ignition loss (misfiring).

The gist of the devices recited in both the aforementioned JP-2004-239115-A and JP-3106434-U is that an electrolytic capacitor having a large capacitance is connected in parallel directly between the positive and negative terminals of the battery, and stabilization is performed by compensating for sudden drops in battery voltage with current released from the electrolytic capacitor. While these devices stabilize the ignition system by way of stabilizing battery voltage, they do not assume countermeasures for the aforementioned problems of back electromotive force that occurs on the primary coil side of the ignition coils.

The present invention is a reflection of the situation described above, and an object thereof is to provide an auxiliary device for engine sparkplug ignition that allows for good sparkplug ignition in all speed ranges (and particularly at high speeds) by eliminating the back electromotive force that occurs in the primary side coil of the ignition coil in engine ignition systems modeled on existing automobiles.

SUMMARY OF THE INVENTION

The problems described above are solved by providing, in a first embodiment of the present invention, an auxiliary device for sparkplug ignition comprising: electrolytic capacitors, each of which is connected in parallel between a positive terminal on a primary coil side of an ignition coil that is connected to a sparkplug and a ground terminal in a direct ignition system for an engine; a plurality of diodes connected, in reverse, in parallel between the positive terminal on the primary coil side of the ignition coil and the ground terminal; and a case for housing the electrolytic capacitors and the diodes, which is fitted with a connector for connecting to the ignition coils and to a power supply.

In a second embodiment of the present invention, the auxiliary device for engine sparkplug ignition of the first embodiment above is provided, wherein the capacitance of each of the capacitors, connected to each of the sparkplugs, is 470 μF to 4000 μF.

In a third embodiment of the present invention, an auxiliary device for engine sparkplug ignition in an ignition system having a distributor for an engine is provided, comprising: an electrolytic capacitor connected in parallel between a positive terminal and a negative terminal on a primary coil side of an ignition coil; a diode connected, in reverse, in parallel between the positive terminal and the negative terminal on the primary coil side of the ignition coil; and a case for housing the electrolytic capacitor and the diode, and fitted with a connector for connecting to the ignition coil and to a power supply.

In a fourth embodiment of the present invention, the auxiliary device for engine sparkplug ignition of the first, second and third embodiments above is provided, further comprising:

a light emitting diode; and a light emitting diode lighting circuit, provided in the case, and in electrical connection with the diode, for lighting the light emitting diode by intermittently supplying power from a battery in response to detection of current supplied to the electrolytic capacitor during sparkplug ignition, so that the lighting of the light emitting diode is visible from the exterior when the engine is running.

Because the auxiliary device for engine sparkplug ignition according to the present invention has the constitution described above, the following advantages are provided:

(1) When the engine is running, back electromotive force generated on the primary coil side of the ignition coil is absorbed by the electrolytic capacitor and thereby suppressed, so that good high voltage can be stably produced on the second coil side, allowing for highly efficient sparkplug ignition.

(2) As a result, ignition loss is limited, whereby engine output is improved.

(3) Because combustion efficiency is improved in all speed ranges, torque drop off is alleviated, which improves acceleration response.

(4) Consequently, engine fuel consumption is lowered and the harmful substance content of the exhaust gas is lowered.

(5) When the engine is running, it is possible to see from the exterior that the device is operating, by way of the lighting (flashing) of the light emitting diode, which makes the benefits of the device appealing to the user when they open the engine compartment.

BRIEF DESCRIPTION OF THE DRAWINGS

The above mentioned features, aspects, and advantages of the present invention will be better understood with regard to the following description and accompanying drawings where.

DETAILED DESCRIPTION OF THE INVENTION

Modes of embodiment of the auxiliary device for engine sparkplug ignition according to the present invention will be described with reference to the drawings.

Figure 1:
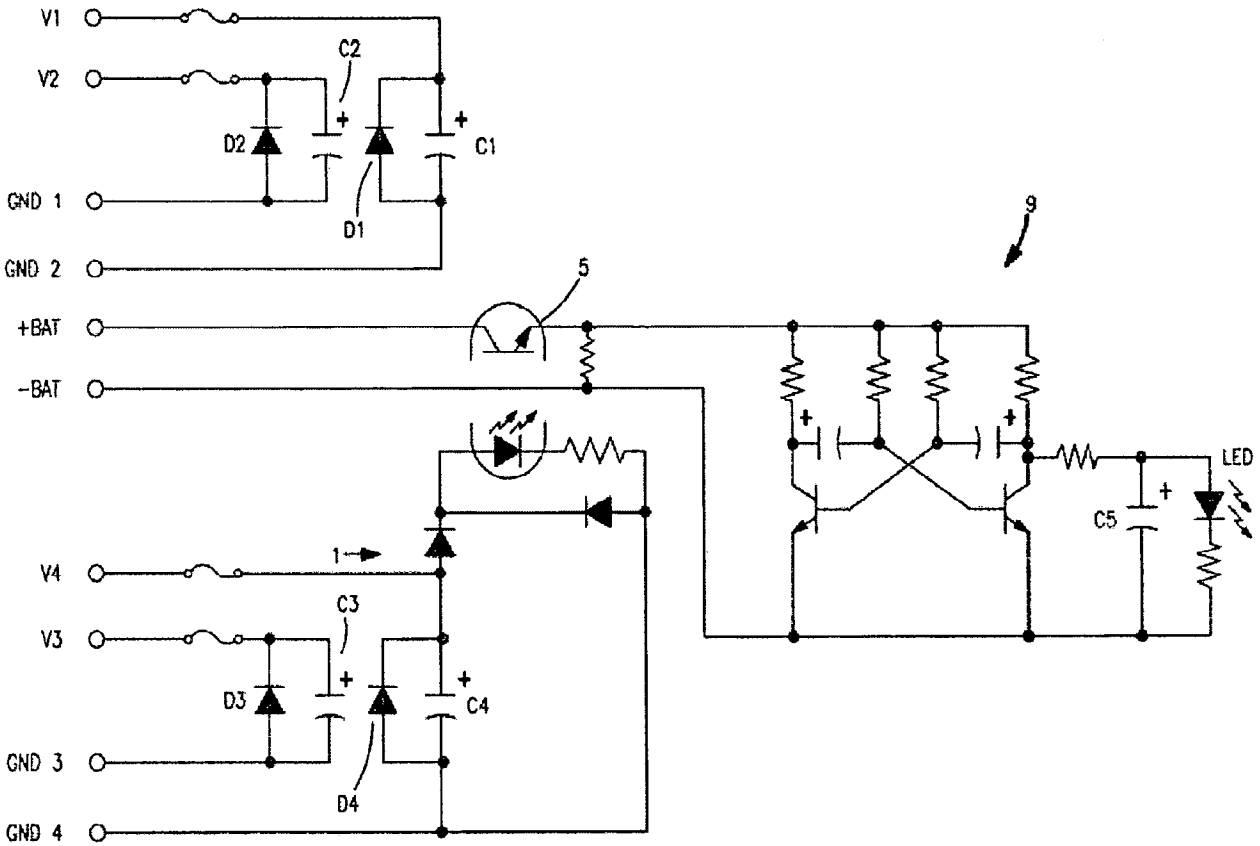
FIG. 1 is a circuit diagram of an auxiliary device for sparkplug ignition according to the present invention, as applied to a direct ignition system for a four-cylinder engine.
Figure 2:
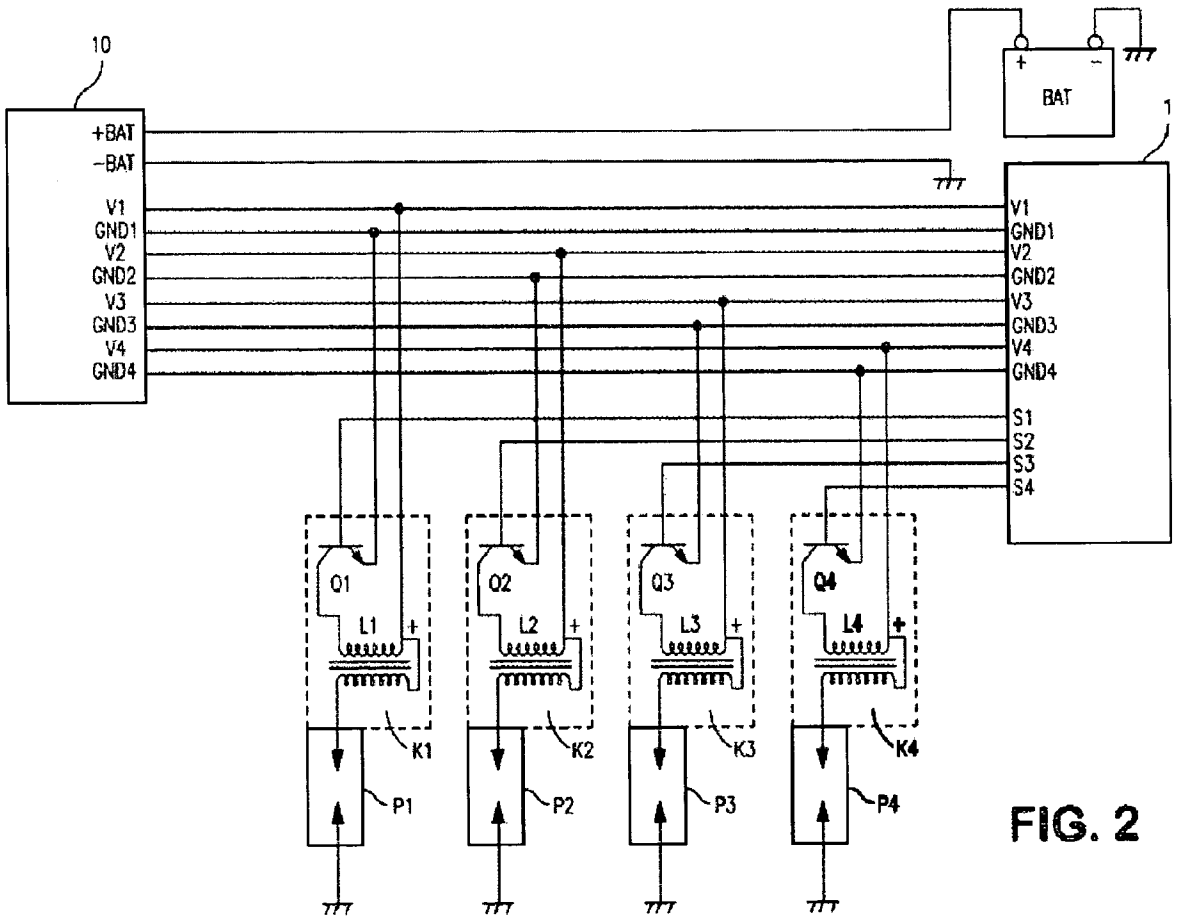
FIG. 2 is a wiring diagram for the direct ignition system of a four-cylinder engine and the auxiliary device for sparkplug ignition according to the present invention.
Figure 3:
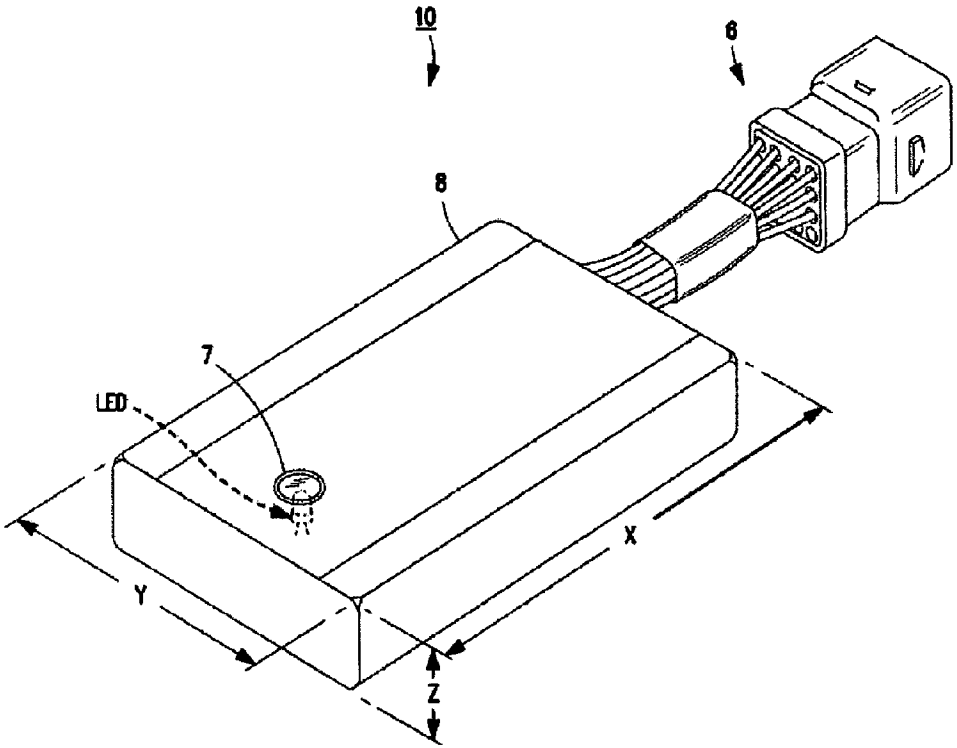
FIG. 3 is a perspective view showing the exterior of an auxiliary device for sparkplug ignition according to the present invention.

As shown in FIG. 1, FIG. 2 and FIG. 3, an auxiliary device for engine sparkplug ignition 10 comprises: electrolytic capacitors C1 to C4 connected in parallel between ground terminals GND 1 to GND 4 and positive terminals (V1 to V4 equals 12 V) of primary coils L1 to L4 of ignition coils K1 to K4, which are connected to sparkplugs P1 to P4 in a direct ignition system for a four-cylinder engine automobile; diodes D1 to D4 for preventing reverse current, which are connected in parallel in the reverse direction between the ground terminals GND 1 to GND 4 and the positive terminals on the primary coils L1 to L4 of the ignition coils K1 to K4; and a case 8, which houses the electrolyte capacitors C1 to C4 (having a capacitance of approximately 1400 μF) and the diodes D1 to D4, and which is fitted with a connector 6 for connecting to the ignition coils K1 to K4 and the power supply (battery BAT.).

Further provided in the case 8 is a light emitting diode lighting circuit 9 for lighting a light emitting diode LED, by intermittently supplying power from the battery BAT., by detecting some of the current i supplied to one of the electrolytic capacitors C4 during sparkplug ignition, so that the lighting of the light emitting diode LED can be seen from the exterior when the engine is running. The light emitting diode lighting circuit 9 may, for example, be such that a photo receptor of a photocoupler 5, such as shown in FIG. 1, operates as a switch so that power is supplied from the battery BAT. only during ignition of the sparkplug P4, and an amplification circuit operates so as to light the light emitting diode LED (slow blinking by way of the parallel capacitor C5).

Furthermore, the case 8 of the auxiliary device for sparkplug ignition 10, which is shown in a perspective view in FIG. 3, is, for example, a compact case having external dimensions X, Y and Z of 120 mm×75 mm×28 mm, and is made of an extremely light, shock resistant aluminum alloy. A small hole 7, provided with a transparent window, is disposed on the top surface of the case, through which it is possible to see the lighting of the light emitting diode LED that is disposed inside the case. Furthermore, as shown in FIG. 3, a connector 6 is provided to connect, using a separate dedicated harness, with the igniter unit 1 and the battery BAT., as well as the positive terminals on the primary coil sides of the ignition coils K1 to K4 and the ground terminals GND 1 to GND 4, as shown in the wiring diagram in FIG. 2.

Figure 4:
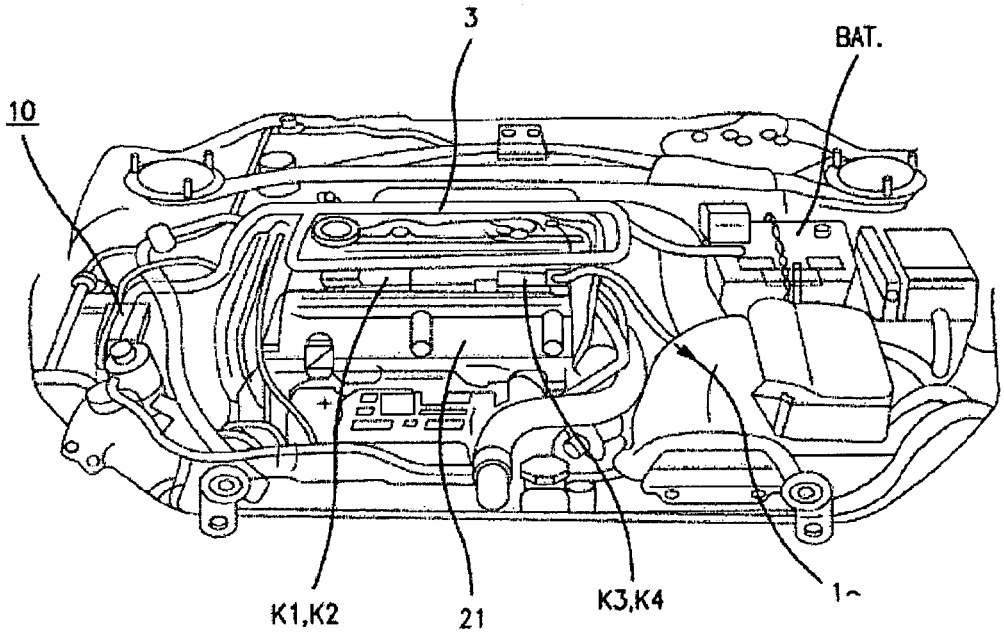
FIG. 4 is a front view of an automobile engine compartment, showing an example of installation of the auxiliary device for sparkplug ignition of the present invention in the engine compartment.

Note that, as shown in FIG. 2, signal lines from the igniter unit 1, which carry ON/OFF control signals S1 to S4 for switching transistors Q1 to Q4, which control the ignition timing (timing for breaking the primary side current flowing in the primary coils) of the sparkplugs P1 to P4, are connected by the dedicated harness, rather than a conventional harness. As will be understood from FIG. 4, when the auxiliary device for sparkplug ignition 10 of the present invention installed in the engine compartment of an actual automobile, it is fixed in place in a suitable open space by screws, two-sided tape or the like, and wiring is secured in a compact manner around the engine 21 using the dedicated harness 3. Here, it is desirable that a separate dedicated harness 3 be designed for each type of vehicle.

Figure 9:
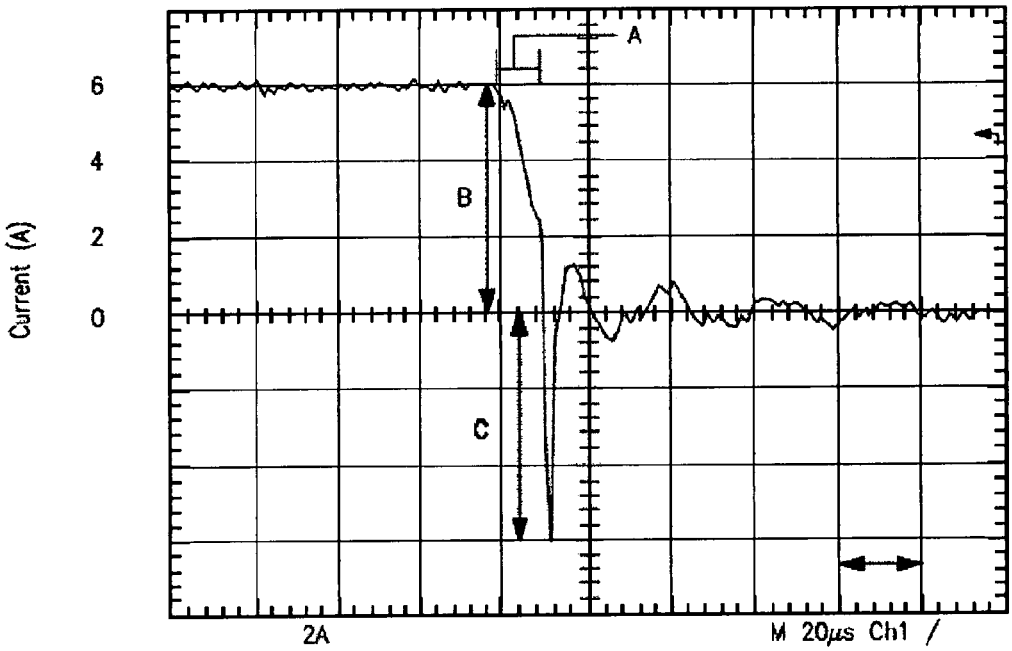
FIG. 9 is a graph of measured data for current waveforms on the primary coil side during sparkplug ignition in a conventional direct ignition system for a four-cylinder engine.

Note that, in the present mode embodiment, the invention was applied to a direct ignition system in a four-cylinder engine, but it is a matter of course that in a six-cylinder engine, an eight cylinder engine or the like, electrolytic capacitors C1 to C-n and diodes D1 to D-n (where n is the number of spark sparkplugs) are provided in the case 8, and these are connected by corresponding connectors 6, by way of dedicated harnesses 3. It will be noted that, with the auxiliary device for sparkplug ignition 10 of the present invention having the structure described above, at the sparkplug ignition time A, as shown in FIG. 9, the back electromotive force that occurs in the primary coils L1 to L4 is absorbed by the electrolytic capacitors C1 to C4 that are connected in parallel between the positive terminal of the primary coils L1 to L4 of the ignition coils K1 to K4 and the ground terminals GND 1 to GND 4. Thus, the drop in the waveform at the sparkplug ignition time A is steepened, and after breaking of the electromotive force, the waveform rapidly converges to a stabilized waveform.

Figure 6:
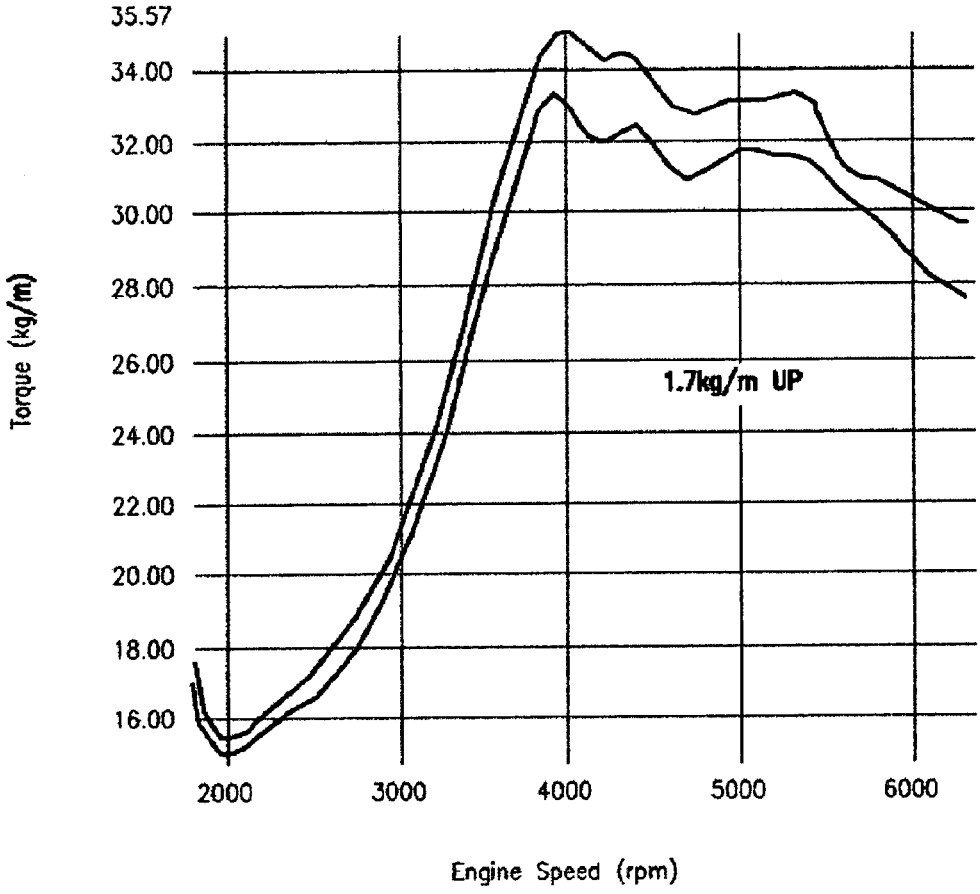
FIG. 6 is a graph showing measured values for torque (kg/m) plotted against engine speed (rpm) for a four-cylinder engine in which the auxiliary device for sparkplug ignition according to the present invention has been installed, and the same engine without the auxiliary device for sparkplug ignition according to the present invention installed.
Figure 7:
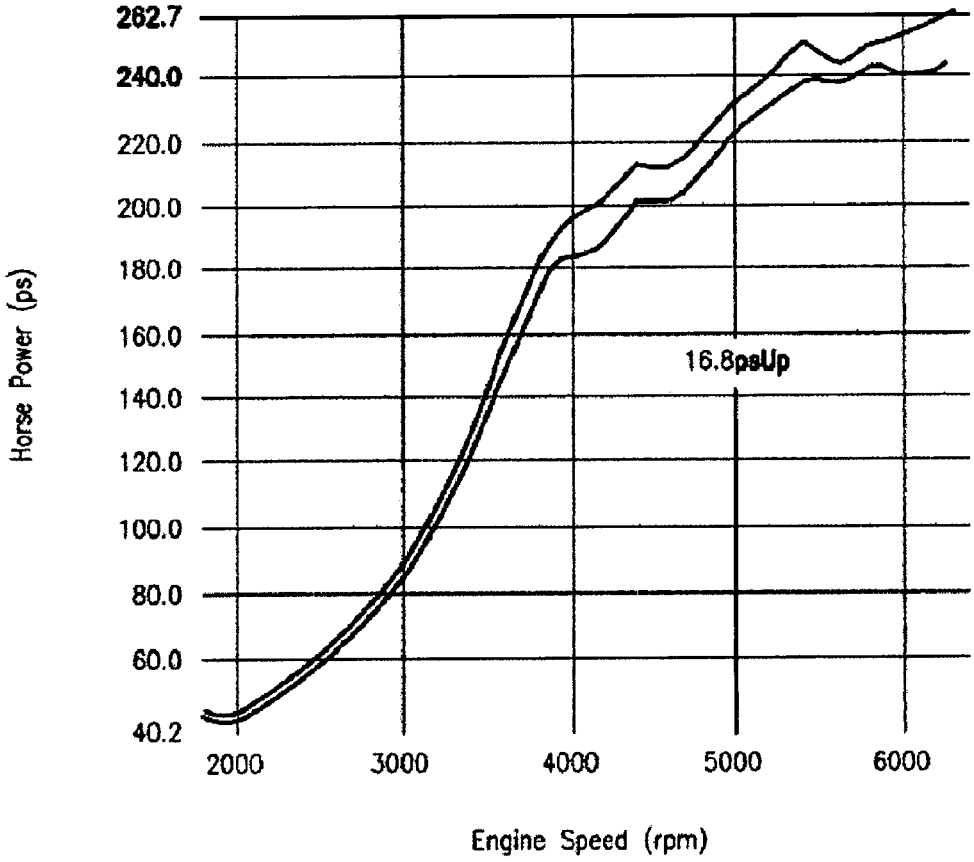
FIG. 7 is a graph showing measured values for metric horsepower (ps) plotted against engine speed (rpm) for a four-cylinder engine in which the auxiliary device for sparkplug ignition according to the present invention has been installed, and the same engine without the auxiliary device for sparkplug ignition according to the present invention installed.

Benefits for the engine ignition system that result from suppression of the back electromotive force, can be understood in concrete terms from, for example, as shown in FIG. 6, the comparative graph showing engine torque vs. engine rpm in a four-cylinder sports car engine, which is increased by 1.7 kg/m, from a conventional maximum torque (at 3937 rpm) of 33.4 kg/m to 35.1 kg/m. Further, as shown in FIG. 7 (showing horsepower vs. engine rpm), the present invention is shown to provide an increase of 16.8 ps, from a conventional maximum horsepower of 245.2 ps (at 6300 rpm) to 262 ps (6300 rpm). It is thus apparent that high-voltage is stably produced in the secondary coils of the ignition coils K1 to K4, allowing for high-efficiency sparkplug ignition. It is also shown that the effect is particularly pronounced in the high speed range (see FIG. 6 and FIG. 7).

Figure 5:
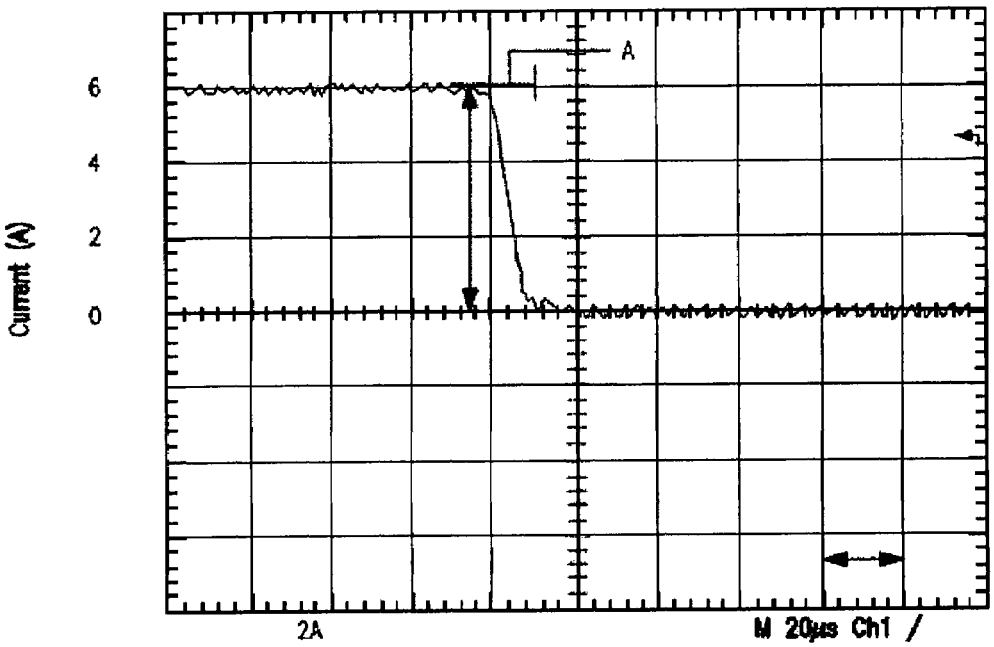
FIG. 5 is a waveform diagram of the primary side current supplied at the time of ignition when the auxiliary device for sparkplug ignition is installed.

Note that, based on the trials performed by the present inventor, it is preferable that the capacitance of the electrolytic capacitors C1 to C4, which are connected to the sparkplugs P1 to P4, be 470 μF to 4000 μF. The graphs in FIG. 5 through FIG. 7 are for a situation in which three 470 μF electrolytic capacitors are connected in parallel (total capacitance 1410 μF=CT=C1+C2+C3). Furthermore, approximately the same effect can be achieved by connecting two 470 μF electrolytic capacitors in parallel. It should be noted that, if the capacitance is too small, it will not be sufficient to absorb the back electromotive force, but if the capacitance exceeds 4000 μF, the charge/discharge responsiveness of the electrolytic capacitor becomes poor in the high speed range and there is a risk of influencing the subsequent ignition timing. Therefore, it is preferable that the capacitance be within the aforementioned range. Of course, the aforementioned capacitance range applies not only to four-cylinder engines, but also to six-cylinder engines and eight-cylinder engines.

Figure 8:
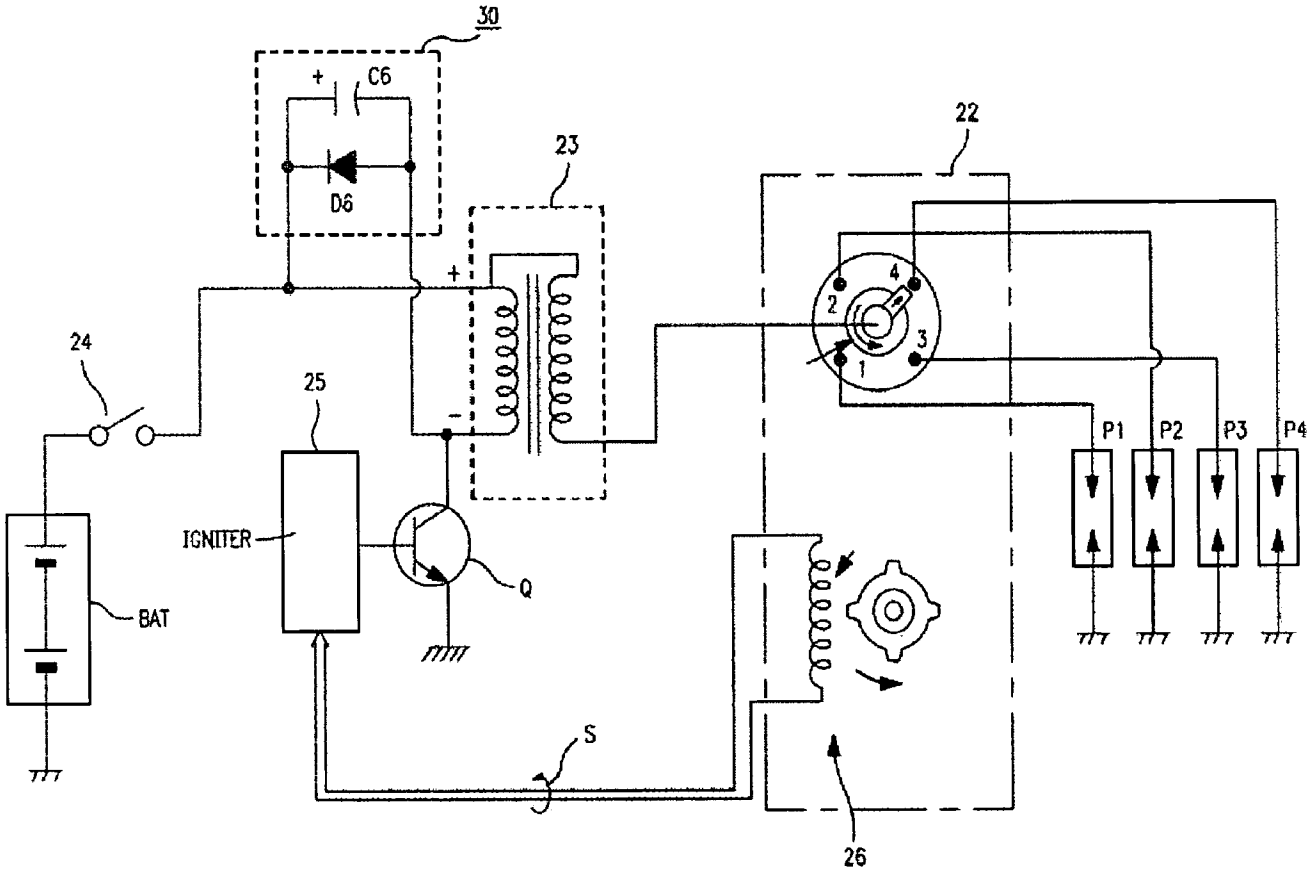
FIG. 8 is a simplified circuit diagram of the auxiliary device for sparkplug ignition according to the present invention as applied to a full-transistor ignition system provided with a distributor for distributing power to four sparkplugs in a four-cylinder engine.

Next, applications for the auxiliary device for sparkplug ignition according to the present invention are not limited to the direct ignition system described above, but rather because the constitution thereof is the same in principle, the present invention can be applied to older full-transistor ignition systems having distributors. FIG. 8 is a simplified circuit diagram of an example of this application.

In FIG. 8, this ignition system is such that an igniter 25 turns a switching transistor Q ON/OFF in accordance with control signals S, generated by a pulse generator 26. The high voltage generated in the secondary coil of the ignition coil 23 is applied to the sparkplugs P1 to P4 at a suitable time by the distributor-switching of a distributor 22, so as to fire the sparkplugs. In this case, the auxiliary device for sparkplug ignition 30 of the present invention is such that an electrolytic capacitor C6, which is connected in parallel between the positive and negative terminals of the primary coil of the ignition coil 23, a diode D6, which is connected in parallel, in reverse, between the positive and negative terminals of the primary coil of the ignition coil 23, and preferably a light emitting diode lighting circuit 9 (not shown in the drawing) are housed in a case 8 similar to that described above; and the case 8 is fitted with a connector for connecting to the ignition coil 23 and the power supply (BAT.).

With this embodiment, it is preferable that the capacitance of the electrolytic capacitor C6 be with a somewhat smaller range (roughly several hundred μF) as compared with the direct ignition system described above. This may be because the firing of four sparkplugs P1 to P4 is performed with one ignition coil 23, which reduces the charge/discharge interval, and necessitates greater responsiveness.

The invention claimed is:

1. An auxiliary device for engine sparkplug ignition in a direct ignition system, comprising:

a plurality of electrolytic capacitors, each of which is capable of being connected in parallel between a positive terminal on a primary coil side of an ignition coil that is connected to a sparkplug and a ground terminal;

a plurality of diodes connected, in reverse, in parallel between said positive terminal on said primary coil side of said ignition coil and said ground terminal; and a case for housing said electrolytic capacitors and said diodes, said case being fitted with a connector for connecting to said ignition coils and to a power supply.

2. The auxiliary device for engine sparkplug ignition recited in claim 1, wherein the capacitance of each of said electrolytic capacitors, connected to each of said sparkplugs, is 470 μF to 4000 μF.

3. An auxiliary device for engine sparkplug ignition in an ignition system having a distributor, comprising:

an electrolytic capacitor connected in parallel between a positive terminal and a negative terminal on a primary coil side of an ignition coil;

a diode connected, in reverse, in parallel between said positive terminal and said negative terminal on said primary coil side of said ignition coil; and a case for housing said electrolytic capacitor and said diode, said case being fitted with a connector for connecting to said ignition coil and to a power supply.

4. The auxiliary device for engine sparkplug ignition recited in claim 1, further comprising:

a light emitting diode; and a light emitting diode lighting circuit, disposed in said case and in electrical connection with the light emitting diode, for lighting said light emitting diode by intermittently supplying power thereto from a battery in response to detection of current supplied to said electrolytic capacitor during sparkplug ignition, wherein the lighting of said light emitting diode is visible from the exterior when the engine is running.

5. The auxiliary, device for engine sparkplug ignition recited in claim 2, further comprising:

a light emitting diode; and a light emitting diode lighting circuit, disposed in said case and in electrical connection with the light emitting diode, for lighting said light emitting diode by intermittently supplying power thereto from a battery in response to detection of current supplied to said electrolytic capacitor during sparkplug ignition, wherein the lighting of said light emitting diode is visible from the exterior when the engine is running.

6. The auxiliary device for engine sparkplug ignition recited in claim 3, further comprising:

a light emitting diode; and a light emitting diode lighting circuit disposed in said case and in electrical connection with the light emitting diode, for lighting said light emitting diode by intermittently supplying power thereto from a battery in response to detection of current supplied to said electrolytic capacitor during sparkplug ignition, wherein the lighting of said light emitting diode is visible from the exterior when the engine is running.

* * * * *